United States Patent [19]

Wozniak

[11] Patent Number: 4,643,427

[45] Date of Patent: Feb. 17, 1987

[54] SET OF SCULPTURAL CONSTRUCTION PIECES

[76] Inventor: Robert A. Wozniak, 1915 E. Wesleyan Dr., Tempe, Ariz. 85282

[21] Appl. No.: 859,445

[22] Filed: May 5, 1986

[51] Int. Cl.[4] ..... A63F 9/08

[52] U.S. Cl. ..... 273/160; 446/85; 52/608

[58] Field of Search ..... D21/104, 108; 52/608, 52/609; 273/157 R, 160; 446/85, 106, 124, 125

[56] References Cited

U.S. PATENT DOCUMENTS

| | | | |
|---|---|---|---|
| D. 253,405 | 11/1979 | Caulkett | D21/108 |
| 1,660,119 | 2/1928 | Decker | 273/160 |
| 3,678,613 | 7/1972 | Geymeier | 446/124 |
| 4,232,473 | 11/1980 | Jenkins | 446/124 |

*Primary Examiner*—William F. Pate, III
*Assistant Examiner*—Dan W. Pedersen
*Attorney, Agent, or Firm*—Charles P. Padgett, Jr.

[57] ABSTRACT

A set of geometric construction pieces, units, or blocks is provided including one large central piece and four pair of decreasingly smaller pieces which can be formed together to form a nested hollow cube for storage purposes. The pieces are manually separable and may be reconfigured or rebuilt to form a plurality of different and distinct geometrical sculptural designs, patterns and structures from the pieces thereof. The set includes a large single central piece formed from six identical, elongated, rectangular legs configured as a single or integral piece forming a partial external skeleton of the nested storage cube such that each face of the cube includes only one pair of adjacent sides with the diametrically opposite face including only the opposite pair of adjacent sides so as to provide an opening into the hollow interior of the piece. A second and a third pair of structurally similar pieces, each dimensioned smaller than the other, and smaller than the single piece are identical in configuration but smaller in size so they can be nestably received within the hollow interior of the first piece. The fourth set of pieces each includes a cube having one pair of diametrically opposite corners missing and being dimensioned so as to be nestably received within the third pair of units. The fifth and last pair of pieces include cubes adapted to be nestably received within the missing corners of each of said fourth pair of pieces. In this manner, each piece nests within the next larger piece until all form a hollow cube having the dimensions of the large single piece with the pieces being readily removable for constructing new different and distinct geometrical sculptural designs, patterns, models, structures, puzzles, constructions, and the like therefrom.

3 Claims, 18 Drawing Figures

SET OF SCULPTURAL CONSTRUCTION PIECES

BACKGROUND OF THE INVENTION

1. Field of the Invention

The present invention relates generally to a novel structure for modular building units of the individual piece or block-type which can be used to construct a variety of geometric sculptures, architectural models, puzzles, patterns, and forms. Such building blocks or units are provided in sets including at least a plurality of individual units which can be used for amusement, artistic and educational purposes.

More specifically, the present invention is characterized by a provision of individual, integrally-formed building blocks, pieces or units having a structure that permits them to be snuggly nested in the form of a hollow cube for storage purposes and the like and which permits individual pieces to be interfitted with respect to one another to form a great variety of individual different and distinct sculptural designs, shapes, models and configurations.

2. Description of the Prior Art

Some modular block building sets of the prior art have utilized connecting elements such as pins, clips, or clamps to hold the blocks in a desired relationship. Such elements detract from the overall appearance of the finished structure and are frequently misplaced, damaged or lost during use. This is especially true when the sets of blocks or pieces are used by children.

Various other prior art building block sets provide, in the structure of the block itself, an arrangement of projections and cooperating grooves or channels whereby one block unit may be attached to an adjacent unit by inserting the projections of one block into the grooves of another. In the construction of such blocks, it has been found that the usefulness of the projections is relatively short-lived as they become worn so as to preclude good registration with the grooves; or they are easily broken off of the block because of their exposed relation to the block surface. Furthermore, such projections can be dangerous and can cause accidental harm to children, damage to property and the like once splintered or partially broken.

Still other block sets have made use of special surface coverings which are mutually cohesive when pressed together while others have resorted to the use of magnets embedded in or below the surface of the blocks. All such structures have the disadvantage, however, of requiring the dismantling of an assembled form should it become necessary to move it about, particularly with regard to structural forms of large dimensions.

Yet another category of prior art modular construction system elements involves the use of a single, repetitive module which includes an integral portion which inter-fits with a major portion of another identical shape module. This arrangement has the advantages of economy and convenience. However, the relative simplicity of such prior art arrangements severly limits the number of inter-fitting combinations and the variety of results in construction assemblies.

Prior art attempts to minimize the shortcomings described above has often involved the use of a system wherein several different shapes or components are used. Although there are some advantages to such systems, they have the disadvantage of increasing the manufacturing costs, inventory problems and needless complications.

Still other modular block sets of the prior art are designed primarily for use as puzzles, but few, if any, are provided which can serve both a puzzle use and a use for general construction of geometric shapes and designs. Furthermore, few, if any, of the building block sets of the prior art provide a set of blocks or pieces which can be inter-fitted together in a compact package for storage purposes and the like and separated into a relatively few number of pieces which nonetheless can be reconfigured to form a great variety of individual different and distinct geometric shapes, designs, sculptures, constructions and the like.

The set of sculptural construction units or pieces of the present invention solves most of the above-identified prior art problems while avoiding their shortcomings.

SUMMARY OF THE INVENTION

It is an object of the present invention to provide a set of modular units which can be structurally inter-fitted to form a wide variety of different and distinct geometric forms, sculptures, models, designs and the like while simultaneously providing a set of pieces which can be nested and inter-fitted together to form a compact cube for storage purposes and the like.

It is another object of the present invention to provide a set of building units or blocks which avoid the problems of the prior art and provide a system with a sufficient variety of possible designs and geometric forms so as to render it continually interesting, entertaining, educational, and fun.

It is another object of the present invention to provide a modular set of building units which can be used as a puzzle.

It is still a further object of the present invention to provide a set of modular building block units which can be inter-fitted with respect to one another without any type of fastening means and built into a wide variety or large number of possible sculptural designs, models, geometric shapes, constructions and the like.

It is yet another object of the present invention to provide a set of modular building pieces or units which can be used for entertainment, artistic and/or educational purposes.

It is still another object of the present invention to provide a set of building blocks having a large central piece and, two pairs of decreasingly, dimensionally smaller yet structurally similar, pieces which can be inter-fitted to one another and nested within one another to form a compact hollow cube for storage purposes and the like.

It is yet a further object of the present invention to provide a building block set including a single central piece and four pair of successively smaller building pieces to form a nine piece set with the largest five pieces being structurally similar to one another with each pair being smaller than the prior pair and adapted to be inter-fitted with respect to one another for storage and design purposes.

It is still another object of the present invention to provide a novel set of nine puzzle pieces of three basic types or shapes which together, can be reconstructed to form a wide variety of geometric designs, sculptures, patterns, models, constructions, and the like.

It is yet another object of this invention to provide a set of sculptural units which can be used to design a particular sculpture and then another party challenged to reconstruct the sculpture against the clock or the like for building block construction and puzzle competitions and the like.

The present invention includes set of interrelated modular blocks, units or pieces for making a plurality of different and distinct geometric sculptural designs, models, structures, and the like. The set includes a first center block, piece or unit having six legs. The first and second legs are integrally coupled to one another to form a first L-shaped member and the third and fourth legs are also integrally coupled to one another to form an identical second L-shape member. A fifth leg is integrally coupled between first end of the first L-shaped member and a first end of the second L-shaped member with the fifth leg positioning the first L-shaped member parallel to the plane of the second L-shaped member and spaced a predetermined distance away. The axis of the fifth leg is perpendicular to the plane of the first and second L-shaped members to position the first and second L-shaped members in parallel planes.

A sixth leg is integrally coupled between the opposite end of the first L-shaped member and the opposite end of the second L-shaped member. The sixth leg positions the first L-shaped member in a plane parallel to and displaced apart from the plane of the second L-shaped member, and it is perpendicular to the planes of both of the first and second L-shaped members and it is identical to, diametrically opposite from and in parallel with the fifth leg.

The first and second L-shaped member together with the fifth and sixth legs form a single integral assembly representing the outer peripheral skeleton, outline or framework of a cube where each face of the cube includes only one adjacent pair of sides and the diametrically opposite face of the cube includes the diametrically opposite pair of adjacent sides. Each of the sixth legs is an elongated rectangular piece which is equal in length and each has its height equal to its width. A second pair of building block units or pieces each includes six legs with each of the set of second six legs being equal in length and having their height equal to their width and equal to the height and width, but not the length, of the six legs of the first central piece. The length of each of the second set of six legs is one height or width less than the length of the first set of six legs of the first block or piece and the second set of six legs is configured into a single integral assembly identical in configuration or shape to the integral assembly of the first unit but dimensionally smaller such that each of the pair of second units can have its legs aligned in parallel with corresponding legs of the first unit and then inter-fitted within the first unit a the nested fashion.

Similarly, a pair of third, dimensionally smaller, structurally similar blocks are provided, and a fourth pair of dimensionally smaller cubes or generally cubic pieces having diametrically opposite corners missing is adapted to be nestably inter-fitted into each of the pair of small third or cubical units. A fifth pair of cube pieces are adapted to be inter-fitted into at least one of the missing corners of each of the pair of fourth building block units so that one of the second, third, fourth, and fifth pair of units and the other of the second, third, fourth and fifth pair of units and the first single unit can be inter-fitted together with one piece nested within another from both sides of the first unit to form a single hollow cube which can be manually disassembled and the pieces used to build or assemble a wide variety of different and distinct structural shapes, designs, geometric models, and the like.

These and other objects and advantages of the present invention will be more fully understood by reading the detailed description of the preferred embodiment of the present invention, the claims, and the drawings which are briefly described hereinbelow.

BRIEF DESCRIPTION OF THE DRAWINGS

FIG. 1 is a perspective view of the set of construction pieces or units of the present invention assembled into a nested cube for storage purposes and the like;

DETAILED DESCRIPTION OF THE PREFERRED EMBODIMENT

Figure 1:
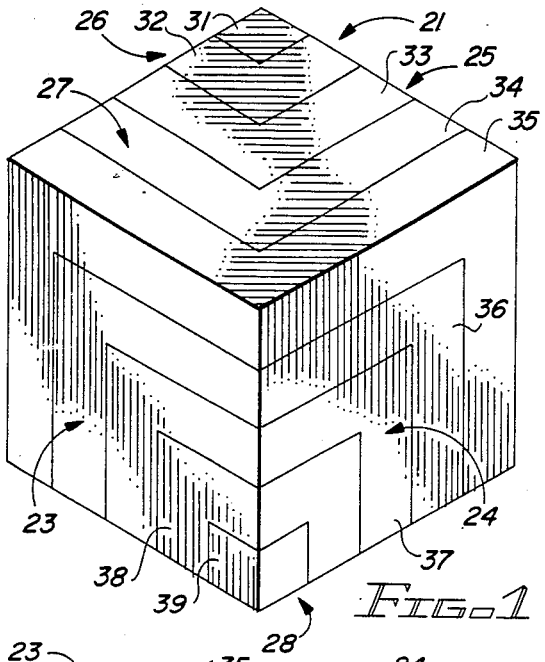
Figure 2:
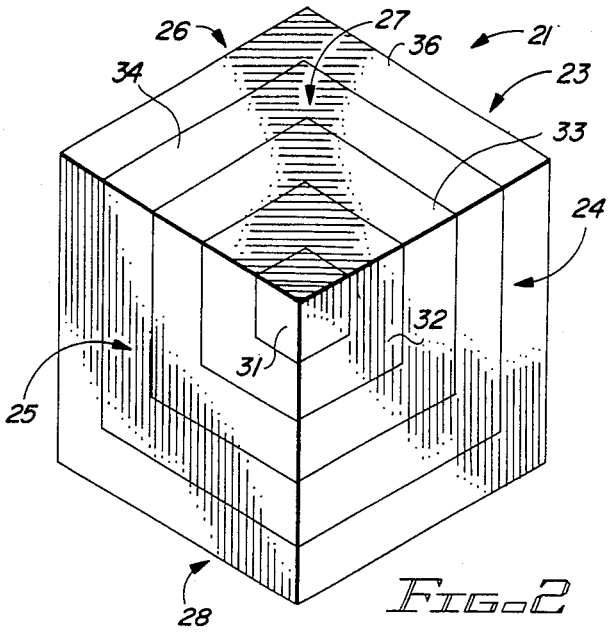
FIG. 2 is a perspective view of the nested assembly of FIG. 1 taken from the diametrically opposite edge thereof.

FIG. 1 shows the set of building blocks, units or pieces of the present invention configured in a nested position to form a hollow cubic storage block 21, while FIG. 2 shows a perspective view of the diametrically opposite side or corner of the storage block configuration of FIG. 1. In FIGS. 1 and 2 the hollow cubical configuration 21 includes a first side 23, a second side 24, a third side 25, a fourth side 26, a top side 27, and a bottom side or surface 28. The individual pieces, units, or building blocks which make up the cube 21 include the individual piece or unit 31, which is in the shape of a relatively small cubic corner piece; a piece 32 in the form of a cube with missing diametrically opposed opposite corners which are adapted to nestably receive the cubic piece 31 therein. The configuration 21 of FIGS. 1 and 2 also include identically configured but differently dimensioned pieces or units 33, 34 and 35. Furthermore, pieces 36 and 37 are substantially identical to pieces 34 and 33, respectively, while piece 38 is substantially identical to piece 32 and the cubic corner piece 39 is identical to the cubic corner piece 31.

Figure 3:
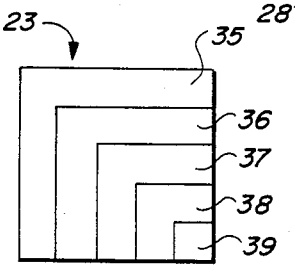
FIG. 3 is a plan view of side one of the nested cube of FIG. 1.
Figure 4:
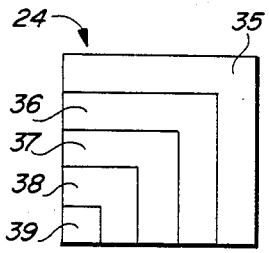
FIG. 4 is a plan view of side two of the cube of FIG. 1.
Figure 5:
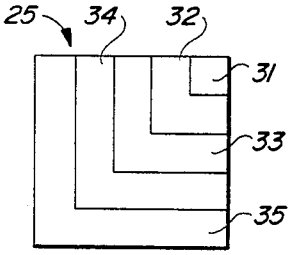
FIG. 5 is plan view of side three of the cube of FIG. 1.
Figure 6:
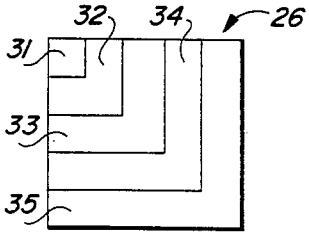
FIG. 6 is a plan view of side four of the cube of FIG. 1.
Figure 7:
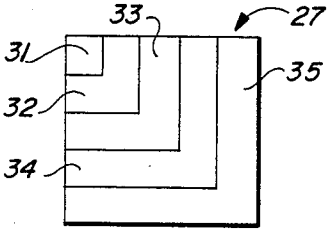
FIG. 7 is a top plan view of the nested cube of FIG. 1.
Figure 8:
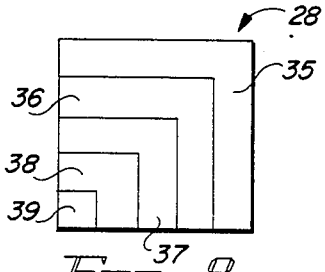
FIG. 8 is a bottom plan view of the nested cube of FIG. 1.

FIG. 3 shows the face 23 of the cube 21 as including at least portions of pieces 35, 36, 37, 38, and 39. FIG. 4 illustrates side 24 which includes at least portions or faces of the pieces 35, 36, 37, 38, and 39. FIG. 5 illustrates the third side of the cubic configuration 21 and shows pieces or units 31, 32, 33, 34, and 35. FIG. 6 shows the fourth and final side of the hollow cube arrangement 21 of FIG. 1 as including at least portions of pieces 31, 32, 33, 34, and 35. FIG. 7 shows the top surface of the cube 21 is shown as including pieces 31, 32, 33, 34, and 35 while FIG. 8 shows the bottom surface 28 including at least portions of pieces 35, 36, 37, 38, and 39.

Figure 9:
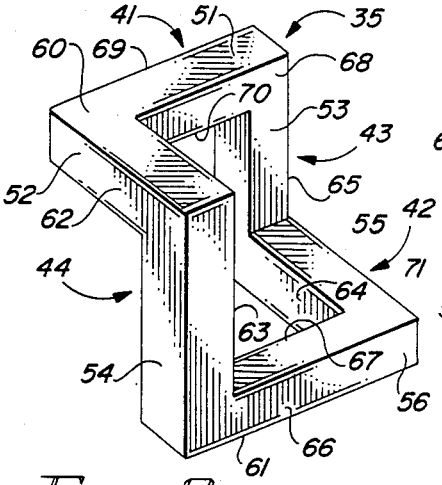
FIG. 9 is a perspective view of the largest single, central piece which defines the outer perimeter of the sculptural cubic block of FIG. 1.

FIG. 9 shows a perspective view of any of the pieces or units 33, 34, 35, 36, and 37, and, for the purposes of illustration, it will be referred to as the single largest piece or unit 35. The unit 35 includes six generally elongated identical legs each having a height equal to its width and a length equal to "$l_1$". The six legs are designated by reference numerals 51, 52, 53, 54, 55, and 56, respectively. Legs 51 and 52 are joined together or integrally formed to define a first L-shaped member or unit 41, while the fifth and sixth legs 55 and 56, respectively, are joined together or integrally formed with one another to form a second identical, generally L-shaped member or unit 42. First and second interconnecting leg members or supports 43 and 44 serve to position the plane of the surface 60 of the first L-shaped member 41 in parallel with the plane of the surface 71 of the second L-shaped member 42 while spacing same a predetermined distance apart equal to the length l, of legs 43 and 44. The first support or interconnecting member 43 includes the third leg 53 which has one end connected to one end of the first L-shaped unit 41 or to the unconnected end of the first leg 51 while the opposite end of leg 53 is connected to one end of the second L-shaped member 42 or to the unconnected end of leg 55. Similarly, leg 54 is connected to the opposite end of the first L-shaped member 41 or to the unconnected end of leg 62 while its opposite end is connected to the opposite end of the second L-shaped member 42 or to the unconnected end of leg 56.

The first L-shaped unit 41 is shown as being formed from legs 51 and 52 with the upper surfaces 60 being coplanar with one another and with leg 52 being generally perpendicular to leg 51 for forming the first L-shaped member 41. The first L-shaped member 41 also includes a lower surface 70 of legs 51 and 52. Similarly, the second L-shaped member 42 has an upper coplanar surface 71 while leg 55 is perpendicular to leg 56 and the lower surface of the second L-shaped member 42 includes a surface 61. The support 43 or leg 53 has its outer surface 65 coplanar with the outer surface of the first leg 55 of the second L-shaped unit 42 for defining an L-shaped, coplanar surface 65 on the outside or exterior side thereof and similar coplanar surface 64 on the inner or opposite side of legs 53 and 55. Yet again, the support 44 which includes leg 54 and the second leg 52 of the first L-shaped member 41 includes a coplanar external surface 62 on the outer or exterior side thereof and a coplanar inner surface 63. The legs 52 and 54 are substantially perpendicular to one another and the leg 54 is also generally perpendicular to the plane of the upper surface 71 and lower surface 61 of the second L-shaped member 42. Similarly, leg 53 is substantially perpendicular to legs 51 and 56. The exterior coplanar surface of legs 54 and 56 define a surface 66 while the internal portions define a surface 67. Likewise, the exterior surfaces of legs 51 and 53 define an external surface 69 and an internal surface 68.

It can be seen that the unit 35 of FIG. 9 and those similar in structure thereto including units 33, 34, 36, and 37, form a partial skeletal outline or frame of a cube with each of the faces of the cube including only a single pair of adjacent sides while the diametrically opposite side of the cube contains only the diametrically opposite pair of adjacent sides so that exactly one half the external skeleton of a cube is formed with the remaining one half of the external skeleton of a cube being missing.

Figure 10:
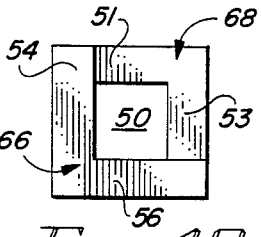
FIG. 10 is a plan view of side one of the unit of FIG. 9.
Figure 11:
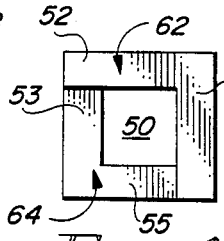
FIG. 11 is a plan view of side two of the unit of FIG. 9.
Figure 12:
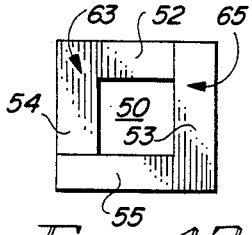
FIG. 12 is a plan view of side three of the unit of FIG. 9.
Figure 13:
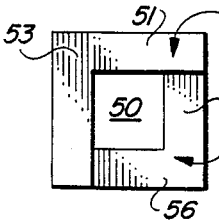
FIG. 13 is a plan view of side four of the unit of FIG. 9.

FIG. 10 shows a plan view of the front side of the unit 35 of FIG. 9 showing at least portions of the leg members 51, 53, 56, and 54. Furthermore, the parallel surfaces 66 of the legs 54 and 56 and the parallel surface 68 of legs 51 and 53 are shown with the hollow square aperture through the center of the skeletal portion 35 being designated by reference numeral 50. FIG. 11 shows a second side of the unit of FIG. 9 illustrating legs 52, 53, 54, and 55 with parallel surfaces 62 of legs 52 and 54 and the parallel surface 64 of legs 53 and 55 being shown surrounding aperture 50. FIG. 12 shows a third side view of the unit 35 of FIG. 9 and illustrates the members 52, 53, 54, and 55 and the surface 63 of legs 52 and 54 which is displaced from but parallel to the surface 65 of legs 53 and 55. The fourth and final side view of the skeletal unit 35 of FIG. 9 shows legs 51, 52, 54 and 56 with the surface 67 of legs 54 and 56 being parallel to and displaced from the surface 69 of legs 59 and 53.

Figure 14:
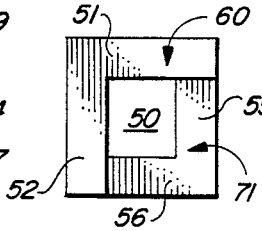
FIG. 14 is a top plan view of the unit of FIG. 9.
Figure 15:
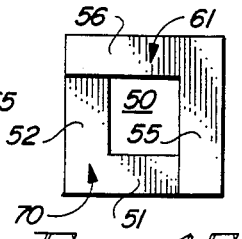
FIG. 15 is a bottom plan view of the unit of FIG. 9.

FIG. 14 shows a top plan view of the configuration of unit 35 of FIG. 9 as including legs 51, 52, 55, and 56. The rear surface 71 of leg 55 and 56 is shown as being parallel to the surface 60 of legs 51 and 52 but displaced therefrom and surrounding or defining central aperture 50. Similarly, a bottom plan view is shown in FIG. 15 as including sides 51, 52, 55, and 56 with the rear surface 70 of legs 51 and 52 being parallel to the surface 61 of legs 55 and 56 but displaced therefrom a predetermined distance with the legs defining a central aperture or opening through the cube from any direction as indicated by reference numeral 50.

Figures 16, 17, 18:
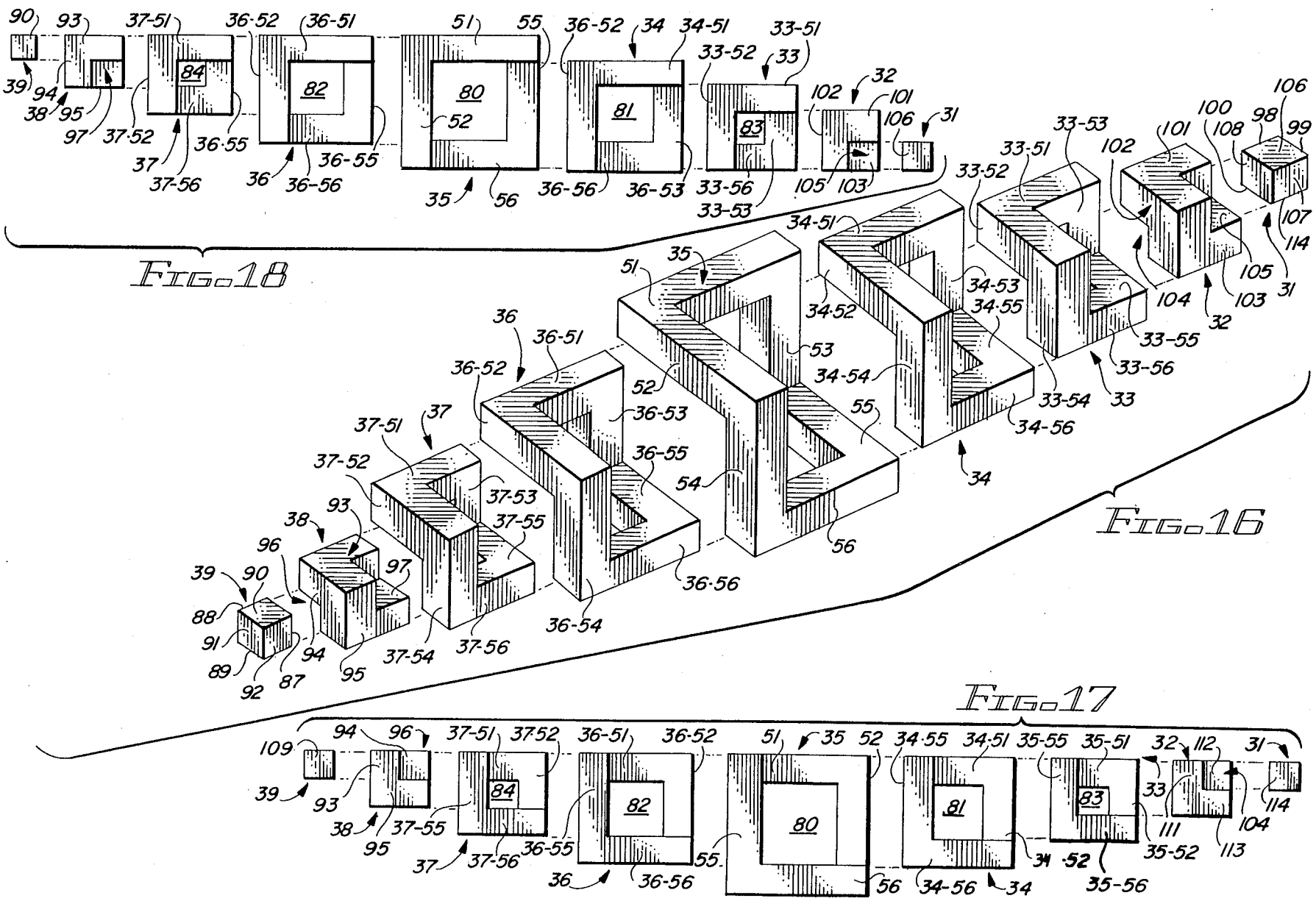
FIG. 16 is a perspective exploded view of the nine individual pieces making up the nested cube of FIG. 1.
FIG. 17 is a bottom plan view of the set of pieces of FIG. 16.
FIG. 18 is a top plan view of individual pieces of FIG. 16.

FIG. 16 shows an exploded perspective view of the 9 piece set of building or construction pieces, units or blocks of the present invention with each of the individual pieces shown in relation to the other pieces for nesting purposes to form the original hollow nested cube of FIGS. 1 and 2. A single large central piece or unit 35 includes six legs 51, 52, 53, 54, 55, and 56, respectively, as described in FIG. 9. A pair of correspondingly shaped or configured pieces 36 and 34 are identical in configuration to piece 35 with each leg being smaller or shorter by a single unit or width or height, but all legs having the same height and width. Similarly, another pair of congruent or identically-shaped but different length pieces 37 and 33 are included with similar parts designated by reference numbers preceded by the unit designating reference numeral. It will be seen that each of these pieces is adapted to fit within the next largest piece in a nested fashion for storage in the hollow cubic configuration 21 of FIG. 1. Next, a pair of pieces 32 and 38 are included with each of these pieces including three equal legs 93, 94 and 95, and 101, 102, and 103, respectively. Each set of three legs is attached to or integral with one another so that each is perpendicular to the axis of the other for forming a cubicle member having one pair of diametrically opposed corner sections (each $\frac{1}{8}$ volume of cube) missing or absent therefrom. Lastly, a pair of cubic block-like end pieces 31 and 39 are provided and are dimensioned to be fitted within at least one of the missing corner sections of the previously cited pieces 32 and 38.

In FIG. 16, the piece 38 is shown as including a first leg 93, a second leg 94, and a third 95. Each of the legs is identical to the other and they are interconnected or integrally formed such that each leg is perpendicular to the other thereby forming the partial skeletal outline of a cube with only one pair of diametrically opposed corners 96 and 97 being absent or missing from the cubic shape of piece 38. An identical small cubical piece 39 includes a single leg or piece having an upper surface 90, a lower surface 109, a first side surface 91, a second side 92, a third side 87, and a fourth side 88. The opposite end block 31 includes an upper surface 106 and a lower surface 114 with four equal sides 98, 99, 107, and 108. We can assign the end pieces 31 and 39 dimensions such that the length "l" is equal to the width "w" which is equal to the height "h", where $l=w=h=1$ unit. Then, we can define each of the pair of end pieces 31 and 39 as $1\times1\times1$ cubes. Then, the dimensions of the partial cubes formed by the second pair of next larger pieces 32 and 38 represent a $2\times2\times2$ cube with a $1\times1\times1$ cubical portion missing from one diametrically opposed opposite pair of corners 96 and 97 thereof. Further, the pair of pieces 33 and 37 represent half the skeleton of a $3\times3\times3$ cube which shows only one pair of adjacent sides on each surface or face of the cube and only the diametrically opposite pair of adjacent sides on the diametrically opposite face of the cube. Similarly, the next larger pair of pieces 34, 36 represent a partial skeletal outline of a $4\times4\times4$ cube while the single center piece or largest piece 35 represents the skeletal outline of one half of a $5\times5\times5$ cube with the hollow interior portion being capable of nestably receiving the nested pieces 31, 32, 33, and 34 within the hollow opening adjacent legs 53 and 55 and such that similarly designate legs of the nested portions abutting similarly designated legs of the central piece 35. Similarly, the nested pieces 36, 37, 38 and 39 are nested within the hollow interior as defined below with legs 52 and 54 forming a hollow $5\times5\times5$ cube having an outer wall thickness of one unit.

FIG. 18 represents a top view of the pieces of FIG. 16 illustrating the legs 51, 52, 55, and 56 of the central piece 35 as framing or defining a central aperture 80; a pair of identical pieces 34 and 35 having similarly designated legs framing apertures 81 and 82, respectively. A third pair of similarly designated pieces 33 and 37 show identically number legs framing a smaller central aperture 83 and 84, respectively. The top of the pieces 32 and 37 show legs 101, 102, and 103; and corresponding legs 93, 94, 95, respectively, together with the missing corner portions 105 and 97, respectively. Lastly, the end pieces 31 and 39 show the upper or top surfaces 106 and 90, respectively.

Similarly, FIG. 17 shows a bottom plan view of the set of pieces in FIG. 16 with similarly designated pieces having similarly designated components as identified in FIGS. 16 and 18 previously.

It will be understood that the individual pieces of the nine piece set shown in the exploded view of FIG. 16 can be manually separated or removed from the nested configuration of FIGS. 1 and 2 and used to build or construct a wide variety of plurality of different and distinct geometric designs, sculptural designs, constructions, puzzles and the like and the pieces of the set of FIG. 16 can be used for any of entertainment, artistic, or educational purposes, as desired.

For example, the pieces of the set of FIG. 16 can be treated as a puzzle with two or more persons competing against time or a clock to configure the pieces into the hollow closed cube of FIG. 1 or some similarly chosen shape. Similarly, various puzzle shapes such as hollow cubes having one open face and the like can be created, and two or more persons can compete to see who can build or solve the puzzle first. Still further, a first person can challenge a second person to repeat or solve a puzzle or duplicate a geometric configuration which he has created and the time kept, and the second person can build his own geometric shape or puzzle and note the time required by the first person to solve his puzzle with the winner being the one with the shortest time.

Many types of competitive puzzles and construction contests can be created from the pieces of the present set for competition, for entertainment for education, and the like. Similarly, the pieces can be inter-fitted, to form a wide variety of geometric designs which can be formed strictly for artistic or entertainment purposes or for educational purposes, and the seemingly endless variety of sculptures which can be created is mind-boggling. The considerable advantage of the pieces of the puzzle or block set of present invention lies in the fact that the pieces can be manually nested within one another for ease of storage after use to form the hollow storage cube of FIG. 1, if desired. Furthermore, the invention is unique in that a relatively few number of pieces, with five being substantially identical in shape but not size, being able to provide the wide variety or number of configurations possible with the set of pieces of the present invention. Furthermore, it will be seen that the central piece 35 can be made any size larger or smaller than that discussed in the preferred embodiment of the present invention and additional nested pieces successively smaller than the pieces 33 and 37 can be added to make the puzzle even more complex and the combination of variables in design construction even greater.

It will be understood by those of ordinary skill in the art that various modifications, changes, and variations may be made in the preferred embodiment of the present invention without departing from the spirit and scope thereof which is limited only the appended claims.

I claim:

1. A set of inter-related modular blocks for making a plurality of different and distinct geometric sculptural designs comprising:

a first block having six legs;

first and second legs being coupled to form a first L-shaped member;

third and fourth legs being coupled to form a second L-shaped member;

a fifth leg coupled between a first end of said first L-shaped member and a first end of said second L-shaped member, said fifth leg positioning said first L-shaped member in a plane parallel to the plane of said second L-shaped member but spaced apart therefrom and being perpendicular to the planes of both said first and second L-shaped members;

a sixth leg integrally coupled between the opposite end of said first L-shaped member and the opposite end of said second L-shaped member, said sixth leg positioning said first member in a plane parallel to and displaced from the plane of second member, being perpendicular to the planes of both of said first and second members, and being diametrically opposite said fifth leg and parallel thereto;

said first and second L-shaped members and said fifth and sixth legs forming a single assembly representing the skeleton of a cube where each face of the cube includes one adjacent pair of legs, and the diametrically opposite face includes the opposite pair of adjacent legs;

each of said six legs being equal in length to one another and each having a length equal to a first predetermined dimension "$d_1$";

a pair of second blocks each having six legs, each of said second six legs being equal in length and having a length equal to a second predetermined dimension "$d_2$", said second six legs being configured into a single integral assembly identical in configuration to the single integral assembly of said first block with $d_2$ being less than $d_1$ by the width of one of said six legs such that each of said second blocks can be aligned with all legs parallel to the corresponding legs of said first block and nested therein from diametrically opposite sides for storage purposes;

a pair of third blocks each having six legs, each of said third six legs being equal in length and having a length equal to a third predetermined dimension "$d_3$", said third six legs being configured into a single integral assembly identical to the integral assembly of said first block and said second block but with $d_3$ being less than $d_2$ by the width of one of six legs such that said each of said third blocks can be aligned with all legs parallel to the corresponding legs of said first and second blocks and nested within said second block for storage purposes;

a fourth pair of blocks each having three legs integral with and perpendicular to one another for forming a cube lacking a pair of diametrically opposite corners, each of said fourth blocks having a fourth predetermined dimension "$d_4$" where $d_4$ is less than $d_3$ by the width of one of said six legs such that said fourth block can be aligned and inserted within each of said fourth blocks for storage purposes;

a pair of fifth cubic blocks dimensioned to be nested into the missing corners of each of said fourth blocks such that all of said first block and each of said pairs of second, third, fourth and fifth blocks may be nested within one another to form a hollow cube having an outer dimension $d_1 \times d_1 \times d_1$ and a wall thickness equal to the width of one of said six legs;

each of the legs of each of said blocks being rectangular and the width and height of said legs being equal, with the lengths of said legs being less than the previous block into which it is nested by one leg width, said blocks being readily disassembled from said nested storage position for building a plurality of different and distinct geometric sculptural designs therefrom.

2. A set of sculptural construction pieces for building a plurality of different and distinct geometric sculptural designs comprising:

a pair of $1 \times 1 \times 1$ of pieces forming a cube having a length "l", a height "h" and a width "w" where $l = h = w = 1$ unit;

a second pair of pieces including three integrally coupled legs each having an equal length of two units and a height and width of one unit, said legs being integrally coupled mutually perpendicular to one another so as to form a $2 \times 2 \times 2$ cube with one pair of diametrically opposite corners measuring $1 \times 1 \times 1$ being missing, said missing corners being adapted to nestably receive one of said $1 \times 1 \times 1$ cubical first pieces therein;

a third pair of pieces including six integrally coupled rectangular legs; each of said legs having a length of two units and a height and width of one unit, said six legs being integrally coupled to form the partial skeleton of a $3 \times 3 \times 3$ cube such that each face of said $3 \times 3 \times 3$ cube includes only one pair of adjacent legs and the diametrically opposite face includes only the diametrically opposed pair of adjacent legs, each face including an opening and each of said third pair of pieces being substantially hollow for operatively nestably receiving each of said first and second nested pieces therein;

a fourth pair of pieces including six integrally coupled rectangular legs, each of said legs having a length of three units and a height and width of one unit, said six legs being integrally coupled to form the partial skeleton of a $4 \times 4 \times 4$ cube such that each face of said $4 \times 4 \times 4$ cube includes only one pair of adjacent legs and the diametrically opposite face includes only the diametrically opposite pair of adjacent legs, each face including an opening and each of said fourth piece is being substantially hollow for operatively receiving each of said first, second and third nested pieces therein;

a single fifth piece including six integrally coupled rectangular legs, each of said legs having a length of four units and a height and width of one unit, each of said six legs being integrally coupled to form a partial skeleton of $5 \times 5 \times 5$ cube such that each face of said $5 \times 5 \times 5$ cube includes only one pair of adjacent legs and diametrically opposite face includes only the diametrically opposite pair of adjacent legs, each face including an opening and said fifth piece being substantially hollow for operatively nestably receiving each of said first, second, third, and fourth pair of pieces therein; and said first, second, third, and fourth pair of pieces and said fifth piece being nestable within each other to form a compact $5 \times 5 \times 5$ hollow cube having a wall thickness of one unit, said pieces being manually separable from the nested storage configuration for manual reconfiguration to form a plurality of different and distinct geometrical sculptural designs and structures therefrom.

3. A set of geometric construction pieces adapted to be nested within one another to form a hollow cube for storage purposes and to be manually separable or reconfigured for forming a plurality of different and distinct geometric sculptural designs, patterns and structures therefrom, comprising:

a first integral piece including leg means for forming a partial external frame work of a first cube, said leg means including six identical elongated rectangular legs each having its height equal to its width, said partial external framework of said first cube including only one pair of adjacent sides being disposed on each face of said first cube such that diametrically opposite faces include only one diametrically opposite pair of adjacent sides thereon;

a pair of second integral pieces each including leg means for forming a partial external frame work of a second cube, said leg means including six identical elongated rectangular pieces having a length and having its height equal to its width, said partial external framework of said second cube including only one pair of adjacent sides of each face of said first cube being disposed such that diametrically opposite faces include only one diametrically opposite pair of adjacent sides;

a pair of third integral pieces including leg means for forming a partial external framework of a third cube, said leg means including six identical elongated rectangular legs having a length and having the height equal to the width, said partial external framework of said third cube including only one pair of adjacent sides on each face of said third cube such that diametrically opposite faces of said cube include only one diametrically opposite pair of adjacent sides thereon;

a pair of fourth integrally formed pieces including leg means for forming a partial external framework of a fourth cube, said leg means including three identical elongated rectangular legs having their height equal to their width, and each having a length, said partial external framework of said fourth cube including a cubic portion equal to one eighth of the volume of said fourth cube being missing from one pair of diametrically opposite corners;

a pair of fifth integral pieces including a cubic member having its length equal to its height equal to its width and adapted to be nestably received within one of the missing corners of each of a corresponding one of said fourth pair of integral pieces; and the length of each of said leg means of said first, second, third, and fourth legs being such that said pieces are adapted to be receivably nested within one another to form a hollow cube for storage purposes, said pieces being manually removable and reconfigurable to form a plurality of different and distinct geometrical sculptural designs, patterns and structures therefrom.

* * * * *